United States Patent [19]

Gryson et al.

[11] Patent Number: 4,911,207

[45] Date of Patent: Mar. 27, 1990

[54] METHOD FOR MONITORING WARP BREAKS ON WEAVING MACHINES, AND A DEVICE WHICH USES THIS METHOD

[75] Inventors: Dirk Gryson, Dikkebus-Ieper; Joos Waelkens, Ieper; Henry Shaw, Vleteren, all of Belgium

[73] Assignee: Picanol N. V., Ieper, Belgium

[21] Appl. No.: 239,627

[22] Filed: Sep. 2, 1988

[30] Foreign Application Priority Data

Sep. 2, 1987 [BE] Belgium ..... 8700982

[51] Int. Cl.[4] ..... D03D 51/28

[52] U.S. Cl. ..... 139/353; 139/336; 139/370.1

[58] Field of Search ..... 139/336, 353, 354, 370.2; 66/163; 340/677, 679

[56] References Cited

U.S. PATENT DOCUMENTS

| | | | |
|---|---|---|---|
| 3,613,743 | 10/1971 | Sakamoto . | |
| 4,178,969 | 12/1979 | Gotoh et al. | 139/336 |
| 4,321,951 | 3/1982 | Hintsch | 139/353 |
| 4,522,236 | 6/1985 | Lohr | 139/353 |
| 4,708,173 | 11/1987 | Yoshida | 139/370.2 |

FOREIGN PATENT DOCUMENTS

| | | |
|---|---|---|
| 899349 | 10/1984 | Belgium . |
| 0234630 | 9/1987 | European Pat. Off. . |

*Primary Examiner*—Henry S. Jaudon

*Attorney, Agent, or Firm*—Bacon & Thomas

[57] ABSTRACT

A method for monitoring warp thread breaks on weaving machines includes the steps of locating broken warp threads and storing the number of broken warp threads in a memory as a function of the postions of the breaks.

5 Claims, 3 Drawing Sheets

6
9
10
8
6
7
3
5
4
2
5
5
2A
11
18
5A
19
17
27
12
28
X
2
22
26
24
21
25
19
13
20
23
22
1
14
31
15
16

METHOD FOR MONITORING WARP BREAKS ON WEAVING MACHINES, AND A DEVICE WHICH USES THIS METHOD

BACKGROUND OF THE INVENTION

This invention concerns a method for monitoring warp breaks on weaving machines, and a device which uses this method, more particularly a method and a device for monitoring warp breaks on weaving machines in which whenever a warp breaks occurs, a number of data items from the point at which the break occurs are stored in a memory, in such a way that they can be processed to make available information about the state of particular machine components, the warp beam used and particular machine settings.

This invention is particularly suited to monitoring of warp breaks in weaving machines which use a warp stop motion consisting of one or more rows of drop wires. Dutch patent application No. 8600372, made by the present applicant, which corresponds to U.S. Pat. No. 4,791,967, issued Dec. 20, 1988, describes a device for determining the position of a warp break on weaving machines with drop wires, in which there are mechanisms that can move underneath the warp stop motion and thus determine the position of a fallen drop wire. This position can then be shown by, at the the point where the fallen drop wire is situated, showing a light signal, bringing up an indicating finger, or gripping the fallen drop wire and presenting it above the other drop wires.

SUMMARY OF THE INVENTION

The aim of the present invention is to provide a method and devices by means of which not only is the position of the broken warp thread sought and shown, but also this position is stored in a memory.

In order to achieve this, the method according to the invention includes the steps of: localizing the broken warp thread relative to the weaving width; providing a signal or signals which are a function of at least the position of the warp break relative to the weaving width, and sending these signals to a memory; storing the number of warp breaks in the memory according to their position relative to the weaving width; and processing the number of warp breaks stored in the memory so as to provide useful information.

In cases where a weaving machine is used which has a warp stop motion with several rows of drop wires, then in a variant of the above-named method, data concerning the rows in which the fallen drop wires are situated can also be stored in the memory.

The device which applies the method according to the invention is intended primarily for weaving machines which use a warp stop motion with drop wires, and includes a combination of: a mechanism for detecting the fallen drop wires; a mechanism for generating a signal or signals according to the point, relative to the weaving width, at which the above-mentioned mechanism detects the fallen drop wires; a memory, connected to the last-mentioned mechanism, for storing the number of warp breaks according to their position relative to the weaving width as determined by the above-mentioned signals; and a processing unit connected to the memory.

BRIEF DESCRIPTION OF THE DRAWINGS

In order to explain the characteristics of the invention, by way of example only and without being limitative in any way, the following preferred embodiments are described with reference to the accompanying drawings, where.

DETAILED DESCRIPTION OF THE PREFERRED EMBODIMENTS

Figure 1:
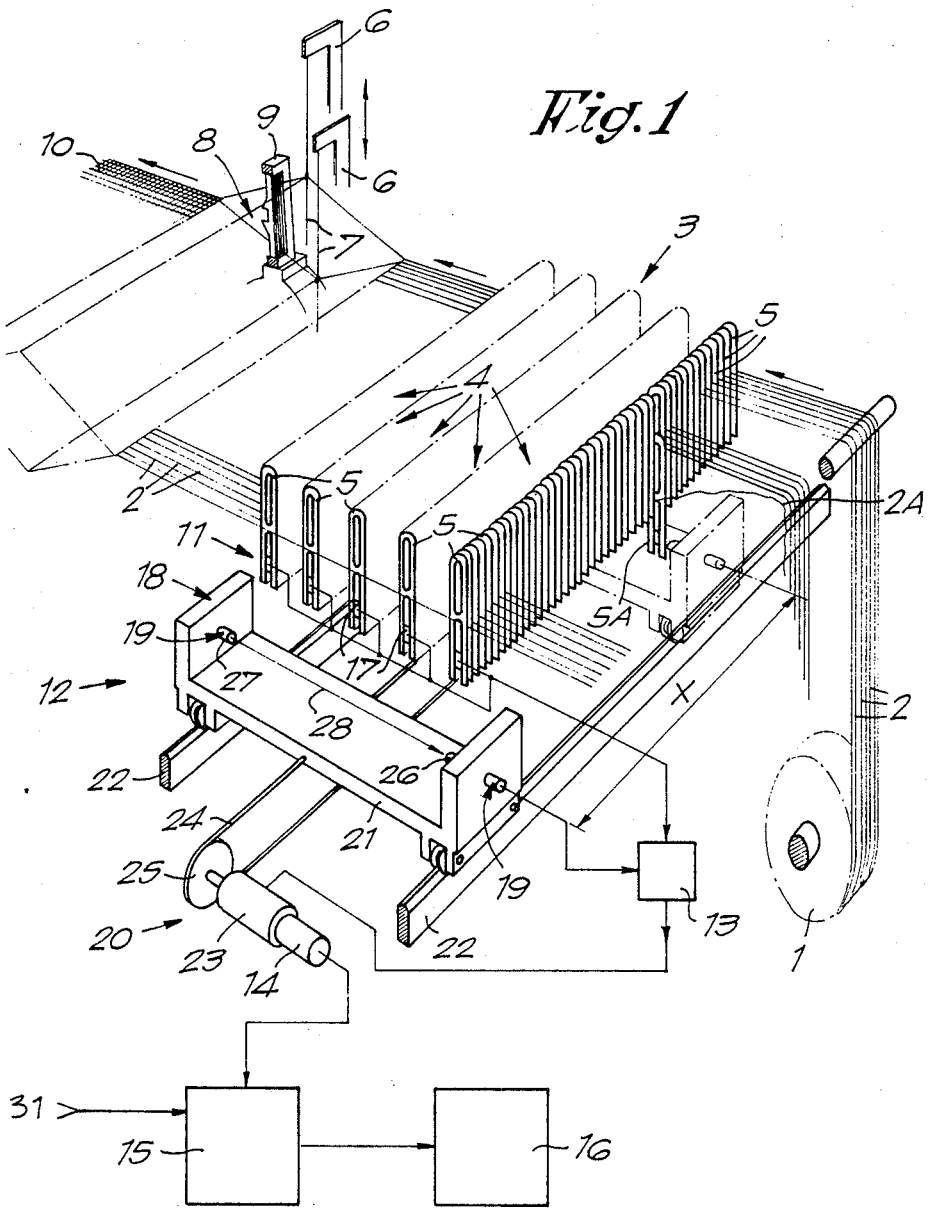
FIG. 1 is a schematic diagram of a device according to the invention.

FIG. 1 is a schematic representation of the weaving process on a weaving machine, with components which themselves are common technology, namely: the warp beam 1; warp threads 2; a warp stop motion 3 with several rows 4 of drop wires 5 suspended on the warp threads 2; frames 6 with heddles 7, whose motion results in the formation of a shed 8; the reed 9; and the woven cloth 10.

The device according to the invention thus a combination of: a detection mechanism 11 for detecting a warp break, which itself is common technology; a mechanism 12 for locating the fallen drop wires 5A, controlled by the switching device 13 connected to the detection mechanism 11; a mechanism 14 for assigning a signal or signals according to the position along the weaving width at which the drop wires 5 have fallen; a memory 15 for storing the number of warp breaks according to their position relative to the weaving width; and a processing unit connected to the memory 15.

The detection mechanism 11 which monitors whether the warp stop motion 3 has one or more fallen drop wires 5A as a result of warp breaks 2A is common technology and consists of e.g., as shown in the diagram, electrodes 17 on which the fallen drop wires make an electrical contact.

The mechanism 12 for localizing the fallen drop wires 5A consists essentially of e.g., as described Dutch patent application No. 8600372 and corresponding U.S. Pat. No. 4,791,967, both made by the present applicant, a detection device 18 which can move along the rows 4 along the weaving width of the weaving machine and which has a detection mechanism 19 which operates on the fallen drop wire 5A, and a drive mechanism 20 for moving the detection device 18. The detection device 18 consists of e.g. a trolley 21 which can travel underneath the drop wires 5 on rails 22, while the drive mechanism 20 consists of an electric motor 23, which moves the trolley 21 by means of a cable 24 running over pulley wheels 25. In the embodiment shown in FIG. 1, the detection mechanism 19 consists of a photoelectric cell 26 and a light source 27, the light beam 28 from which can operate on the fallen drop wire 5A, but without differentiating the row 4 in which the fallen drop wire 5A is situated.

The mechanism 14 for assigning a signal or signals according to the point at which the fallen drop wire 5A is located consists of e.g. a sensor and signal processor (encoder) connected to the motor 23, by means of which a signal or signals is passed to the memory, according to the position along the weaving width relative to a fixed reference point on the weaving machine at which the drop wire concerned 5A has fallen. Each time a warp break occurs, this position is stored in the memory 15, in such a way that the number of warp breaks as a function of their position relative to the weaving width is known. For example, a shaft encoder such as described in U.S. Pat. No. 3,381,288 is exemplary of a shaft encoder usable for such an application.

Said memory 15 can be connected to a processing unit 16, such as for instance a display unit, which converts into useful information the number of warp breaks stored in the memory 15 as a function of their position relative to the weaving width. The operation of the device described for this purpose can be simply deduced from FIG. 1. Whenever the detection mechanism determines that a fallen drop wire 5A is present, it passes a command to the switching mechanism 13, with the result that the drive 20 is activated, so that the mobile detection mechanism 18 begins to move under the drop wires 5. When the detection mechanism 19 registers a fallen drop wire 5A, the drive 20 is deactivated. While the detection device is moving and/or after it has stopped, the mechanism 14 generates one or more signals, according to the position "X" at which the detection mechanism registers the fallen drop wire 5A, and sends it to the memory 15, where the number of warp breaks is stored as a function of "X". This operation is repeated every time a warp break occurs, so that the number of warp breaks which occur at point "X" relative to the weaving width is known, measured for example over a particular time interval. All this data is then converted into useful information by the processing unit, enabling the weaver or the technician to check the point at which warp breaks are concentrated.

Figure 2:
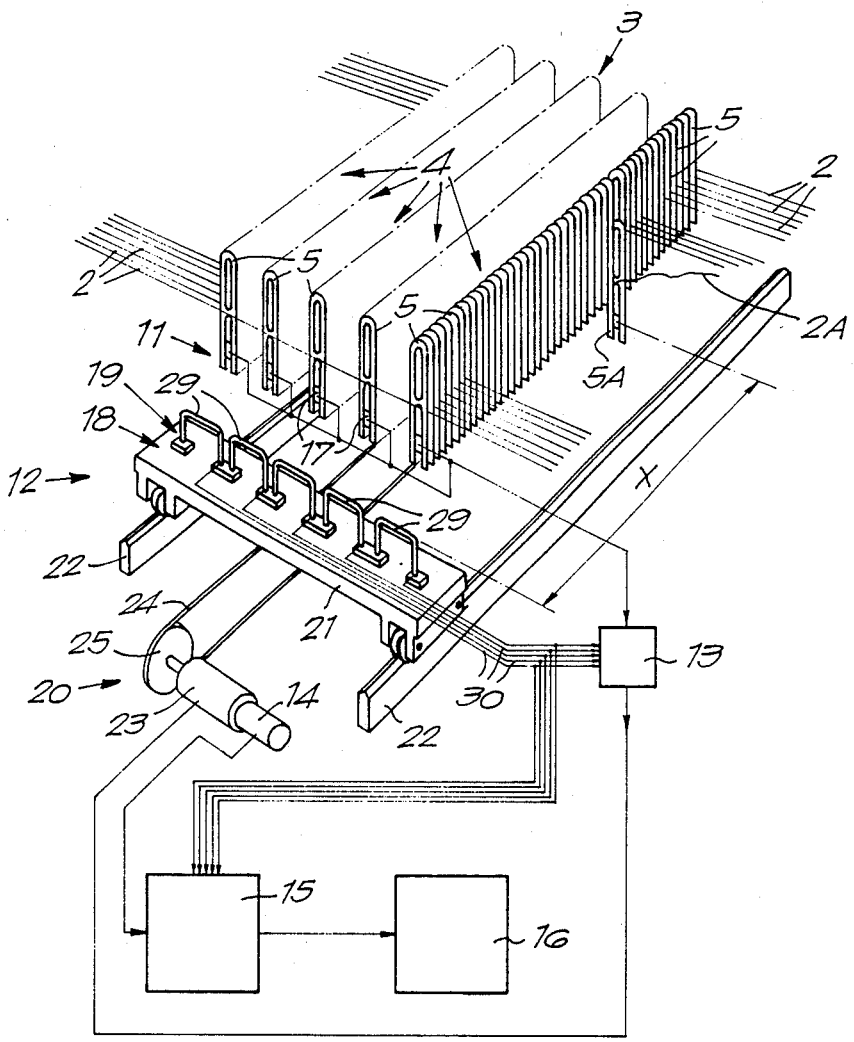
FIG. 2 represents a variant of the device shown in FIG. 1.
Figure 3:
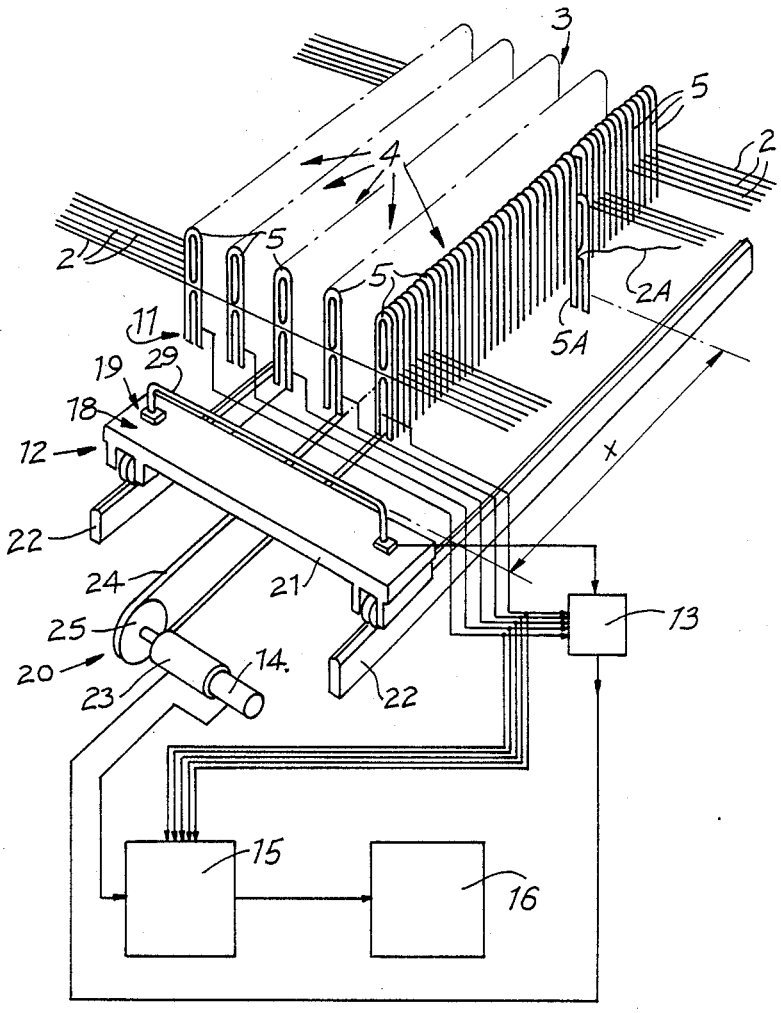

The embodiment shown in FIG. 2 uses a detection mechanism 19 consisting of a number of separate contact elements 29 corresponding to the number of rows 4. Each contact element 29 is connected to an electrical conductor 30 which in turn is connected to the switching mechanism 13 and to the memory 15, so that the number of warp breaks is also stored in the memory 15 as a function of the rows 4 in which the corresponding drop wires 5A are located.

The operation of the device shown in FIG. 2 is fairly similar to the operation of the device shown in FIG. 1, with the difference that the number of warp breaks is also stored in the memory 15 as a function of the rows of drop wires 4.

In another embodiment (not shown in the figures) it is also possible for the electrodes 17 to provide the required information about the row of drop wires 4 in which the fallen drop wire 5A is located as a result of the warp break. This makes it unnecessary to use a separate detection mechanism 19 for each row of drop wires.

Each time a warp break occurs, by storing in memory 15 the position of the fallen drop wire 5 relative to the weaving width, and possibly also according to the row 4, and processing all this data in a processing unit 16, important information about the state of particular machine components can be obtained. For example, in case of damage to the drop wires 5, the heddles 7, the reed 9, the temples, the selvedge formers etc., the warp threads are subject to particularly heavy wear and have a much higher chance of breaking at the point where the defective machine components are situated. Clearly, therefore, by determining the point at which warp breaks continually occur, relative to the weaving width and possibly also according to the row 4, the cause of the warp breaks can be found fairly quickly.

In addition, important information concerning the warp beam used can be obtained from the data stored in the memory 15, in particular about weak points in one or more warp threads, the presence of completely bad threads, damage to the warp beam etc. Damaged warp threads are always more liable to result in breakages than other threads. Also, incorrect machine settings, such as a squint backrest roller or warp stop motion, or heddles not moving freely in a frame, etc., can result in a large number of warp breaks occurring at particular points, so that information about particular machine settings can be deduced from the data stored in memory.

If the locations of the warp breaks are known, the weaver or the technician can inspect the point at which warp breaks are concentrated.

If the data from several machines are stored in the same memory, for example via connection 31, and compared with each other, then collective faults can be discovered and remedied, as can construction faults in the machines.

The present invention is in no way limited to the embodiments described by way of example and shown in the accompanying drawings; on the contrary, such a method and mechanisms for monitoring warp breaks on weaving machines can be made in all sorts of variants while still remaining within the scope of the invention.

We claim:

1. A method for monitoring warp thread breaks on a weaving machine, comprising the steps of:

upon the occurrence of a broken warp thread, locating the position of the broken warp thread relative to the weaving width of the weaving machine;

generating a signal which is indicative of each warp thread break and the position of said break relative to said weaving width;

passing each of said signals to a memory signal storing means;

processing said signals in said storing means to make intelligible to an operator of the machine the number of occurrences of thread breaks as a function of their position relative to said weaving width.

2. A method as claimed in claim 1, wherein said weaving machine includes a warp stop motion including several rows of drop wires associated with the warp threads for detecting warp thread breaks, said method further comprising the steps of generating a drop wire row signal containing information indicative of the row of drop wires in which the drop wire associated with the broken warp is located; passing said row signal to said signal storing means; and including in said signal processing step the step of processing said row signal to make intelligible to an operator of the machine the numbers of occurrences of warp thread breaks as a function of their position relative to the rows of drop wires in which the breaks occurred.

3. A device for monitoring warp thread breaks on a weaving machine of the type in which warp thread breaks are detected by means of a warp stop motion including drop wires associated with the warp threads, comprising:

warp thread break locating means for locating the position of the fallen drop wires relative to the weaving width of the weaving machine;

signal generating means for generating signals indicative of the occurrence of a fallen drop wire and the position at which said break locating means detects the fallen drop wires on each occurrence of a warp thread break;

memory signal storing means arranged to receive said signals; and signal processing means connected to the memory signal storing means for processing said signals and making intelligible to an operator of the machine the number of warp thread break occurrences as a function of their position relative to said weaving width.

4. A device as claimed in claim 3, wherein said warp stop motion includes several rows of drop wires and further wherein said break locating means includes means for locating the position of the row in which a fallen drop wire in located;

second signal generating means arranged to generate row signals including information indicative of the position of the row in which a fallen drop wire is located;

said signal storing means arranged to receive said row signals; and said processing means arranged to process said row signals with the signals indicating the occurrence and location of fallen drop wires and to make intelligible information concerning the numbers of warp thread breaks as a function of the rows of drop wires in which thread breaks have occurred.

5. A device as claimed in claims 3 or 4, wherein the break locating means comprises a detection mechanism movable along the drop wires across the weaving width of the weaving machine by means of a motor; said signal generating means comprising a sensor and encoder connected to said motor and arranged ot provide information of the position of the warp thread breaks relative to said weaving width.

* * * * *